US011053802B2

(12) United States Patent
Gossilin et al.

(10) Patent No.: US 11,053,802 B2
(45) Date of Patent: Jul. 6, 2021

(54) TURBINE BLADE OR A TURBINE VANE FOR A GAS TURBINE

(71) Applicant: Siemens Aktiengesellschaft, Munich (DE)

(72) Inventors: Ralph Gossilin, Oberhausen (DE); Andreas Heselhaus, Düsseldorf (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 15 days.

(21) Appl. No.: 16/479,572

(22) PCT Filed: Jan. 8, 2018

(86) PCT No.: PCT/EP2018/050351
§ 371 (c)(1),
(2) Date: Jul. 19, 2019

(87) PCT Pub. No.: WO2018/141504
PCT Pub. Date: Aug. 9, 2018

(65) Prior Publication Data

US 2019/0368358 A1 Dec. 5, 2019

(30) Foreign Application Priority Data

Jan. 31, 2017 (EP) ..... 17153962

(51) Int. Cl.
*F01D 5/18* (2006.01)

(52) U.S. Cl.
CPC ..... *F01D 5/185* (2013.01); *F05D 2240/81* (2013.01); *F05D 2260/201* (2013.01); *F05D 2260/22141* (2013.01)

(58) Field of Classification Search
CPC ..... F01D 5/185; F05D 2240/81; F05D 2260/201; F05D 2260/22141
See application file for complete search history.

(56) References Cited

U.S. PATENT DOCUMENTS 5,387,086 A * 2/1995 Frey ..... F01D 5/187 416/96 R
6,174,134 B1 * 1/2001 Lee ..... F01D 5/187 416/97 R (Continued)

FOREIGN PATENT DOCUMENTS

CN 102116179 A 7/2011
CN 202055870 U 11/2011

(Continued)

OTHER PUBLICATIONS

PCT International Search Report and Written Opinion of International Searching Authority dated Mar. 27, 2018 corresponding to PCT International Application No. PCT/EP2018/050351 filed Jan. 8, 2019.

*Primary Examiner* — Eldon T Brockman

(57) ABSTRACT

A turbine blade or vane for a gas turbine has successively along a radial direction of the gas turbine, a root for attaching the turbine blade or vane to a carrier, a platform, an aerodynamically shaped hollow airfoil with a suction side wall and a pressure side wall extending with respect to the direction of a hot gas flow from a common leading edge to common a trailing edge and extending transversely thereof from the platform to an airfoil tip. The airfoil has at least one cooling cavity extending in a cooling fluid flow direction from a platform level to the airfoil tip, the cooling cavity in fluid connection with a number of cooling fluid outlets distributed along the trailing edge through an array of impingement cooling features located therebetween. The array extends into a region which is located radially outside the airfoil within the platform having impingement cooling features.

6 Claims, 2 Drawing Sheets

(56) References Cited

U.S. PATENT DOCUMENTS

| | | | | |
|---|---|---|---|---|
| 8,292,582 | B1 | 10/2012 | Liang | |
| 2003/0133795 | A1* | 7/2003 | Manning | F01D 5/187 416/97 R |
| 2007/0048133 | A1 | 3/2007 | Palmer et al. | |

FOREIGN PATENT DOCUMENTS

| | | | |
|---|---|---|---|
| CN | 107109949 | A | 8/2017 |
| EP | 0034961 | A1 | 9/1981 |
| EP | 0860689 | A2 | 8/1998 |
| EP | 1467065 | A2 | 10/2004 |
| EP | 3232001 | A1 | 10/2017 |
| JP | H08503530 | A | 4/1996 |
| JP | 2007064226 | A | 3/2007 |
| WO | 9412767 | A1 | 6/1994 |
| WO | 2016076834 | A1 | 5/2016 |

* cited by examiner

TURBINE BLADE OR A TURBINE VANE FOR A GAS TURBINE

CROSS REFERENCE TO RELATED APPLICATIONS

This application is the US National Stage of International Application No. PCT/EP2018/050351 filed Jan. 8, 2018, and claims the benefit thereof. The International Application claims the benefit of European Application No. EP17153962 filed Jan. 31, 2017. All of the applications are incorporated by reference herein in their entirety.

FIELD OF INVENTION

The invention relates to a turbine blade or a turbine vane for a gas turbine.

BACKGROUND OF INVENTION

Both turbine blades and turbine vanes for gas turbines are well known in the prior art. They comprise besides a root for attaching the turbine blade or vane to a carrier usually a platform and an aerodynamically shaped hollow airfoil attached thereon. The hot gas surfaces of the airfoil and of the platform are arranged in general perpendicular to each other. They merge into each other while establishing a fillet shaped transition region, which is often called just fillet. In operation said fillets are highly thermally loaded as well as the platforms and airfoils itself. More specifically in the vicinity of the airfoil trailing edge at the pressure side very high thermal loadings appear. At the same time, this fillet region is difficult to cool.

To cool said region it is known to apply film cooling holes in the fillet or nearby. However, said film cooling holes generate a stress concentration leading to a reduced lifetime of the turbine blade or turbine vane. Furthermore, cooling films from said film cooling holes often can hardly be brought into that specific area. Therefore it is known, i.e. from U.S. Pat. No. 5,387,086 to provide serpentine cooling channels in turbine airfoils, which are equipped with riblike turbulators to enhance the heat transfer and to lessen thermal loadings.

Another known solution to reduce the thermal load in the vicinity of the airfoil trailing edge on the radial level of the fillets provides cooling channels located inside of the airfoil, equipped with turbulators at platform level to increase locally inside cooling. However, this method is comparatively ineffective since it acts only on a weak level and could only applied in a region close to the leading edge of the airfoil and in hot gas direction along the chord of the airfoil downstream thereof, but not close to the trailing edge of the airfoil due to space restrictions.

Further, it is also known to use cooling holes drilled trough the platform parallel to the platform surface. However, this measure is difficult to manufacture and accordingly rather expensive.

SUMMARY OF INVENTION

An aim of the invention is therefore to provide a turbine blade or turbine vane which is easy to manufacture and which enables sufficient cooling of the fillet in the vicinity of the airfoil trailing edge.

An object of the invention is achieved by a turbine vane or a turbine blade according to the independent claim. The dependent claims describe advantageous developments and modifications of the invention. Their features could be combined arbitrarily.

In accordance with the invention there is provided a turbine blade or a turbine vane for a gas turbine comprising successively along radial direction of said gas turbine a root for attaching the turbine blade or turbine vane to a carrier, a platform and an aerodynamically shaped hollow airfoil comprising a suction side wall and a pressure side wall extending with respect to the direction of a hot gas flow from a common leading edge to common trailing edge and extending transversely thereof from said platform to an airfoil tip, wherein the airfoil comprises at least one cooling cavity extending in accordance to a cooling fluid flow direction from a platform level to said airfoil tip, said at least one cooling cavity being in fluid connection with a number of cooling fluid outlets distributed along the trailing edge through an array of impingement cooling features located there between, wherein said array extends into a region which is located radially outside the airfoil within the platform, wherein said region comprises also impingement cooling features. With other words the array of impingement cooling features radially does not end above the hot gas surface of the platform, but extends radially into the platform region.

Hence the main idea of the invention is to simply extend these impingement cooling features into an area underneath the platform level. The platform level of the turbine blade or turbine vane can be determined schematically from the outwardly directed platform surface along which the hot gas of the gas turbine flows.

The invention is based on the knowledge, that the array of impingement cooling features comprises excellent cooling capability which should be used also for reducing the temperature of the fillet in the vicinity of the airfoil trailing edge. The vicinity of the airfoil trailing edge is determined by the hot gas flow direction and covers the chord section directly upstream of the trailing edge of the airfoil. With this easy measure the thermal load in said region can be reduced easily without any side effects.

It is noted that said platform region extends significantly into an area which is located radially according to the platform. The term "significantly" is to be understood in that way that not only impingement cooling features for cooling fluid has to be located partly underneath said level, but each row of impingement cooling features comprises at least one, which is completely located inward of the platform.

In summary the invention helps to prevent cracking in the sensitive fillet region meeting for the life targets of the turbine part without the application of stress-increasing film cooling holes. Also, if the turbine blade or turbine vane is coated with a thermal barrier coating (TBC) and/or bond coat, its linkage to the underlying layer or substrate is improved.

Further advantage is the easy implementation of the invention since turbine blades or turbine vanes are usually manufactured by investment casting using appropriate casting cores which represents later on the cooling channels in the finally manufactured part. With the invention only the casting core is to change accordingly to the invention and other design changes are not needed. This results in low costs for implementing the invention.

In a first embodiment the impingement cooling features are formed as staggered cross-over-holes, wherein at least one of said rows comprises at least one cross-over-holes located completely radially inward of the platform level. This leads to a significant temperature reduction of the material of the turbine blade or turbine vane in the vicinity of the trailing edge while increasing the lifetime of the product.

These features enable an appropriate size of a platform region having an improved cooling for the transition from the airfoil to the platform.

In a further embodiment the impingement cooling features are formed as staggered pin fins, the pin fins have—as seen in longitudinal section of the turbine blade or turbine vane—a rectangular shape. In comparison to arrays of pin fins having a circular shape, the rectangular shapes further increases the heat transfer between the material of the turbine blade or of turbine vane and the cooling fluid flow passing the subchannels between adjacent pin fins of the array. Nevertheless, also any or any desired shape of pin fins is possible.

In a further embodiment said cooling cavity is also bordered from an airfoil stiffening rip ending radially inwardly at a rip end at a turnaround section of said cooling fluid, said rip end located radially inward of said platform level. Further, the rip and the array end underneath the platform on the same level. Hence the airfoil stiffening rip is also extended—in comparison to the airfoil stiffening rips known from the prior art—into said platform region which improves the cooling fluid supply of that section of the array of pin fins which is located underneath the platform level.

BRIEF DESCRIPTION OF THE DRAWINGS

Embodiments of the invention are now described, by way of example only, with reference to the accompanying drawings of which.

DETAILED DESCRIPTION OF INVENTION

Figure 1:
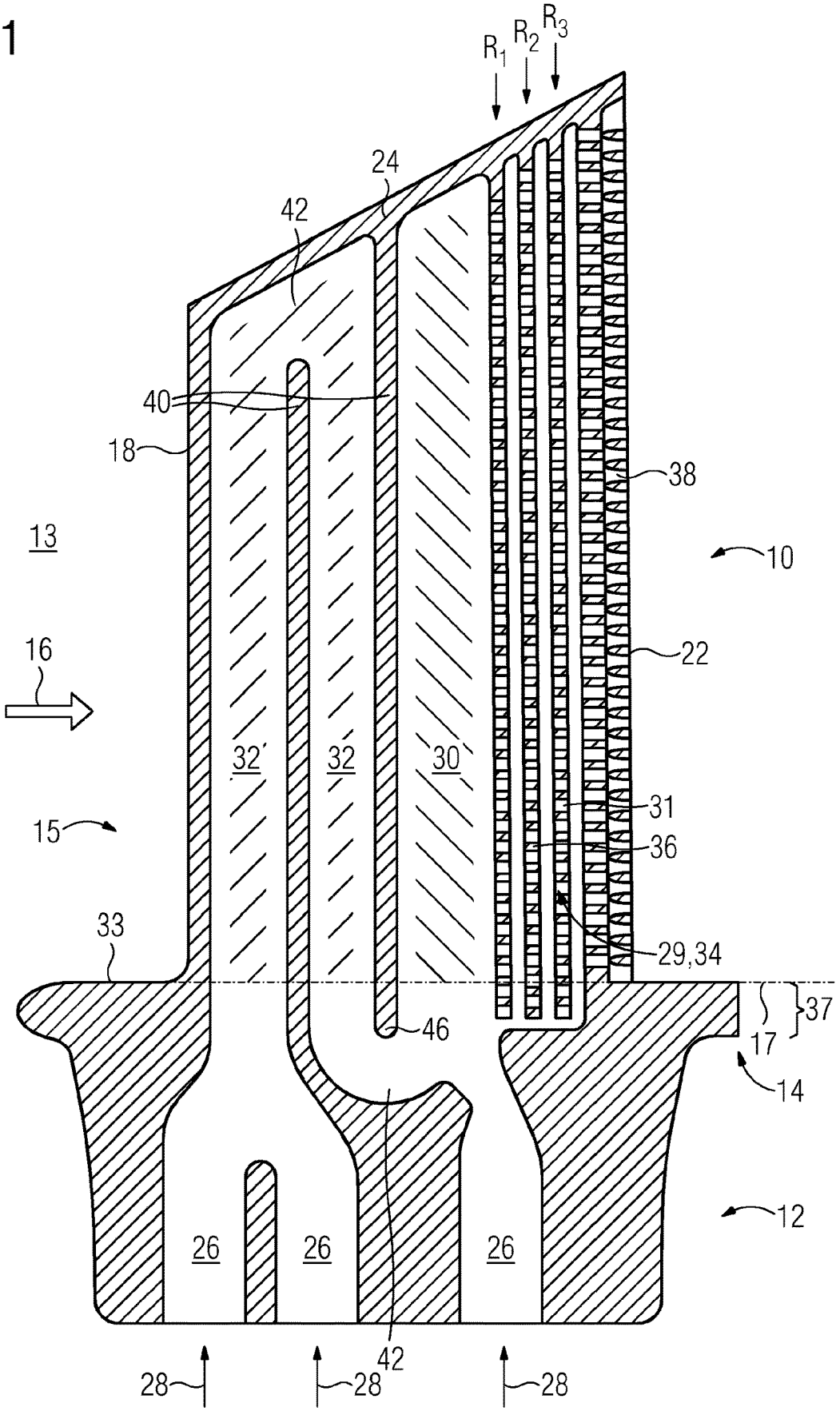
FIG. 1 shows a longitudinal cross through a turbine blade.

The illustration in the drawings is in schematic form. It is noted that in different figures, similar or identical elements may be provided with the same reference signs.

Figure 2:
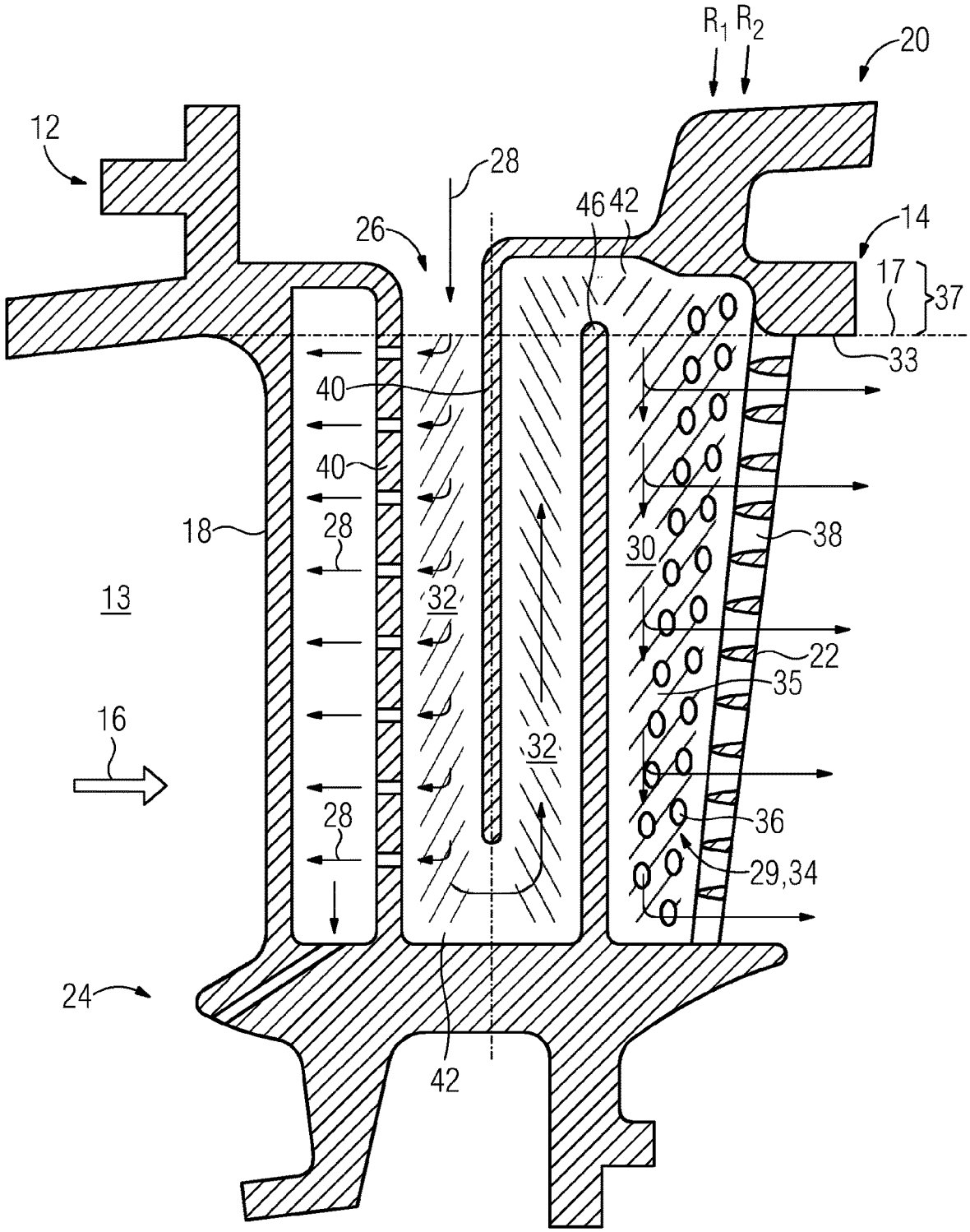
FIG. 2 shows a longitudinal cross section through a turbine vane.

FIG. 1 shows a longitudinal cross section through a turbine blade 10 according to the invention and FIG. 2 shows also a longitudinal section through a turbine vane 20 according to the invention.

The turbine blade 10 and turbine vane 20 each comprise a root 12 for attaching the respective part to a carrier. With respect to the turbine blade 10 the carrier could be designed as a rotor disk while with respect to the turbine vane 20 the carrier could be designed as a turbine vane carrier. Rotor disks and turbine vane carriers are well known in the prior art. Turbine vanes 20 can also be fixed at their inner diameter via u-rings.

Both the turbine blade 10 and turbine vane 20 comprises further successively along a radial direction of said gas turbine a platform 14 and an aerodynamically shaped hollow airfoil 15 comprising a suction side wall and a pressure side wall extending with respect to the direction of a hot gas flow 16 from a common leading edge 18 to a common trailing edge 22 and extending transversely thereof from said platform 14 to an airfoil tip 24. For turbine vanes 20 said airfoil tip is also known as vane head. Further each the turbine blade 10 and the turbine vane 20 comprises cooling fluid entries 26 through which during operation of the gas turbine cooling fluid 28 could be fed into the interior. Each entry 26 is in fluid connection with a cooling cavity 30 through one or more cooling passages 32. Each of said cooling passages a cooling cavity 30 extends substantially between the platform 14 and the airfoil tip 24. In view of the cooling fluid direction an array 34 of impingement cooling features 29 follows the cooling cavity 30. Further downstream of the array 34 of impingement cooling features 29 a number of cooling fluid outlets 38 are arranged in the trailing edge 22 of the airfoil 15.

As displayed in FIG. 1 the array of impingement cooling feature 29 could comprise three rows of cross-over-holes 31 followed by the cooling fluid outlets 38 while the array 34 of impingement cooling features 29 of the turbine vane 20 comprises only two rows pin fins 36. Each pin fin 36 connects the suction side wall with the pressure side wall for enabling heat transfer from said wall into the cooling fluid stream surrounding the pin fins 36. Within each row of pin fins 36 subchannels 35 are provided for passing the cooling fluid towards the cooling fluid outlets 38.

The individual cooling passages 32 and cooling cavity 30 are separated by a set of airfoil stiffening rips 40. As displayed in the drawings the individual cooling passages and cooling cavities mergers into each other in turnaround sections 42.

Each platform 14 has a first surface 33 facing the hot gas path 13. As shown by the dashed line said first surface 33 determines radially a platform level 17.

Said platform level 17 defines the separating plane between the airfoil 15 and the platform 14. According to the invention the array 34 of cross-over-holes 31 or pin fins appears on both sides of said platform level 17 hence extending radially significantly into a platform region 37 that is located radially outside the airfoil 15 within the platform 14.

In operation cooling fluid 28 is fed through the entries 26 to the turbine blade 10 or turbine vane 20 and flows through their cooling passages 32 into the cooling cavity 30 from which it distributes into the individual subchannels located between the pin fins of the first row of pin fins 36. Downstream thereof the cooling fluid impinges onto the pin fins of the subsequent rows located of respective subchannels cascadely.

Hence also in the platform region 37 said cooling occurs. This reduces the temperature of the airfoil walls and especially the fillet between airfoil 15 and platform 14, also upstream with regard to the hot gas flow direction of the trailing edge 22 without technical disadvantages that film cooling holes would generate if applied there. Finally the heated cooling fluid leaves the airfoil 15 at the trailing edge through the outlets 38.

Of course the idea of the array extending into the platform is also applicable for turbine vanes 20 at their inner diameter platform. Even pin fins were explained on the basis of the turbine vane 20 and cross-over-holes 31 were explained on the basis of the turbine blade 10, it is understood that pins fins could be applied in turbine blades and cross-over-holes 31 could be applied in turbine vanes, both alone or in combination the corresponding impingement cooling feature 29.

As displayed in FIGS. 1 and 2 the airfoil stiffening rip 40 which separate the cooling passage 32 from the cooling cavity 30 ends with its rip end 46 on the same radial level as the array 34 ends. This provides a reliable cooling fluid supply for this section of the array 34, which is outside of the airfoil 15.

The invention claimed is:

1. A turbine blade or turbine vane for a gas turbine, comprising successively along a radial direction of said gas turbine, a root for attaching the turbine blade or turbine vane to a carrier, a platform, an aerodynamically shaped hollow airfoil comprising a suction side wall and a pressure side wall extending with respect to the direction of a hot gas flow from a common leading edge to common a trailing edge and extending transversely thereof from said platform to an airfoil tip, at least one cooling cavity defined in an interior of said airfoil, said at least one cooling cavity extending in accordance to a cooling fluid flow direction from a platform level to said airfoil tip, a number of cooling outlets distributed along the trailing edge, and at least two rows of impingement features disposed between said at least one cooling cavity and the number of cooling outlets and extending along the radial direction, wherein said at least two rows of impingement features comprise impingement cooling features configured to direct said cooling fluid from said at least one cooling cavity to the number of cooling fluid outlets in a direction parallel to the direction of the hot gas flow, and wherein said at least two rows of impingement features extend into a region which is located radially outside the airfoil within the platform comprising also the impingement cooling features.

2. The turbine blade or turbine vane according to claim 1, wherein the impingement cooling features are formed as cross-over-holes, at least one cross-over-hole completely located within the platform.

3. The turbine blade or turbine vane according to claim 1, wherein the impingement cooling features are formed as pin fins, wherein the pin fins have, as seen in longitudinal section of the turbine blade or turbine vane, a rectangular shape.

4. The turbine blade or turbine vane according to claim 1, wherein said cooling cavity is also bordered from an airfoil stiffening rib ending radially inwardly at a rib end at a turnaround section for said cooling fluid, said rib end located radially inward of said platform level.

5. The turbine blade or turbine vane according to claim 4, wherein the rib and the array end underneath a platform hot gas surface on the same level.

6. The turbine blade or turbine vane according to claim 1, wherein the impingement cooling features in a row of said at least two rows of impingement cooling features are radially staggered with the impingement cooling features in an adjacent row of said at least two rows of impingement cooling features.

* * * * *